US007393422B2

(12) United States Patent
Nagao

(10) Patent No.: US 7,393,422 B2
(45) Date of Patent: Jul. 1, 2008

(54) METHOD FOR PRODUCING HIGH CARBON STEEL WIRE ROD SUPERIOR IN WIRE-DRAWABILITY

(75) Inventor: Mamoru Nagao, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 507 days.

(21) Appl. No.: 11/022,792

(22) Filed: Dec. 28, 2004

(65) Prior Publication Data

US 2005/0155672 A1 Jul. 21, 2005

(30) Foreign Application Priority Data

Jan. 20, 2004 (JP) ..... 2004-012332

(51) Int. Cl.
*C21D 8/06* (2006.01)

(52) U.S. Cl. ..... 148/598; 148/595; 148/654; 148/664

(58) Field of Classification Search ..... 148/600–602, 148/595, 598, 320–336, 654, 660, 664, 661
See application file for complete search history.

(56) References Cited

U.S. PATENT DOCUMENTS

| | | | |
|---|---|---|---|
| 5,776,267 | A | 7/1998 | Nanba et al. |
| 6,322,641 | B1 | 11/2001 | Makii et al. |
| 6,645,319 | B2 | 11/2003 | Nagao et al. |
| 6,783,609 | B2 | 8/2004 | Hata et al. |
| 6,800,147 | B2 | 10/2004 | Nagao et al. |
| 2004/0129354 | A1 | 7/2004 | Nagao et al. |
| 2005/0155672 | A1 | 7/2005 | Nagao |

FOREIGN PATENT DOCUMENTS

| | | |
|---|---|---|
| EP | 0 624 658 A1 | 11/1994 |
| EP | 1 277 846 A1 | 1/2003 |
| JP | 3-60900 | 9/1991 |
| JP | 4-346618 | 12/1992 |
| JP | 6-346190 | 12/1994 |
| JP | 11-302743 | 11/1999 |

(Continued)

OTHER PUBLICATIONS

U.S. Appl. No. 11/022,792, filed Dec. 28, 2004, Nagao.

(Continued)

*Primary Examiner*—Deborah Yee
(74) *Attorney, Agent, or Firm*—Oblon, Spivak, McClelland, Maier & Neustadt, P.C.

(57) ABSTRACT

The high carbon steel wire rod contains 0.65% to 1.20% of C, 0.05% to 1.2% of Si, 0.2% to 1.0% of Mn, and 0.35% or less (including 0%) of Cr, further contains P and S each in an amount restricted to 0.02% or less, where 80% or more of the metal structure is constituted by a pearlite structure; and an average tensile strength TS and an average lamellar spacing λ of the high carbon steel wire rod show the relation of $TS \leqq 8700/\sqrt{(\lambda/Ceq)}+290$ in which Ceq=% C+% Mn/5+% Cr/4. The high carbon steel wire rod can omit a patenting treatment before or during wire drawing, is superior in wire drawability, and exhibits a low drawing resistance in a wire drawing die in an as-hot-rolled state.

3 Claims, 1 Drawing Sheet

FOREIGN PATENT DOCUMENTS

| | | |
|---|---|---|
| JP | 2001-179325 | 7/2001 |
| JP | 2004-137597 | 5/2004 |
| JP | 2004-149816 | 5/2004 |
| JP | 2004-288589 | 10/2004 |
| JP | 11-315348 | 11/1999 |
| JP | 2000-63987 | 2/2000 |
| KR | 2001-0008462 | 2/2001 |
| WO | WO 2004/029315 A1 | 4/2004 |

OTHER PUBLICATIONS

U.S. Appl. No. 10/968,253, filed Oct. 20, 2004, Nagao et al.
U.S. Appl. No. 10/528,263, filed Mar. 17, 2005, Nagao et al.
U.S. Appl. No. 11/296,299, filed Dec. 8, 2005, Minamida et al.
Patent Abstracts of Japan, JP 2000-063987, Feb. 29, 2000.

METHOD FOR PRODUCING HIGH CARBON STEEL WIRE ROD SUPERIOR IN WIRE-DRAWABILITY

BACKGROUND OF THE INVENTION

1. Field of the Invention

The present invention relates to a high carbon steel wire rod with a reduced drawing resistance in a drawing die and superior in wire drawability, in an as-hot-rolled state.

2. Description of the Related Art

As wire rods to be subjected for drawing into very thin wires for use in steel cords or semiconductor cutting saw wires, a high carbon steel wire rod (corresponding to JIS G3502: SWRS72A, SWRS82A) are used that have a carbon content of about 0.7 to 0.8% and a diameter of 5.0 mm or more. If these high carbon steel wire rods are broken in a wire drawing work, the productivity is impaired markedly. To avoid this, the high carbon steel wire rods need to have excellent wire drawability.

Heretofore, for attaining an excellent wire drawability of a high carbon steel wire rod, there has been adopted a method where after hot rolling, the wire rod is cooled with water and then subjected to blast-cooling to make the wire rod structure into a fine pearlite structure, or a method where the wire rod is further subjected to intermediate patenting once or twice before or during a wire drawing process.

Recently, high carbon steel wires have been required to have smaller wire diameters. To meet this requirement and also from the standpoint of improving the productivity, it is desired to provide a direct patenting material or a direct drawing material which permit omission of the patenting treatment before or during wire drawing. To increase the productivity, the high carbon steel wire rods have been increasingly required to have a more excellent breakage resistance and the improved die life.

To meet such requirements, various techniques for improving the wire drawability of the high carbon steel wire rods have been proposed. Japanese Published Examined Patent Application No. 3-60900, for example, proposes a technique to control the tensile strength and the proportion of coarse pearlite, which is recognizable under an optical microscope of 500×, contained in pearlite into appropriate values dependently on C equivalent of a high carbon steel wire rod.

Japanese Patent Application Laid-Open No. 2000-63987 proposes a technique where an average colony diameter of the pearlite structure in a high carbon steel wire rod is set at 150 μm or less and an average lamellar spacing is set at 0.1 to 0.4 μm to thereby improve the wire drawability. Incidentally, the colony indicates a region where lamellar directions of pearlite are regular. The plural colonies form a nodule or a block which is a region where the ferrite crystal orientation is constant. As described in these techniques, the wire rod after hot rolling is produced by adjusting its coiling temperature by water-cooling and then adjusting the amount of blast by a Stelmor adjusting cooler.

According to the technique described in Japanese Published Examined Patent Application No. 3-60900, the die life is improved because a coarse pearlite having a coarse lamellar spacing is present about 10% to 30%. The technique however suffers from insufficient resistance to wire breaking during wire drawing and also an insufficient wire drawability, both required for a direct patenting material or a direct drawing material.

The technique of Japanese Patent Application Laid-Open No. 2000-63987 can improve the die life by making the lamellar spacing somewhat coarser, i.e., to 0.1 to 0.4 μm.

Making the lamellar spacing coarser like this results in an average colony diameter of as coarse as 40 μm or more (see its working Examples). This is an insufficient breakage resistance required for a direct patenting material or a direct drawing material.

U.S. Pat. No. 6,783,609 proposes a technique where in order to improve the die life, the lamellar spacing of pearlite is made somewhat wider to decrease the strength of the wire rod, in addition to reducing an average grain diameter of a pearlite nodule which has a physical meaning as a crystal grain to a certain value or smaller. The technique improves the breakage resistance and attains excellent wire drawability even in the case of a pearlite structure having a relatively wide lamellar spacing.

Japanese Patent Application Laid-Open No. 11-302743 proposes a technique to produce a high strength steel wire rod where the breakage resistance is not deteriorated even when the wire rod could be flawed during conveyance with consequent formation of a hard structure subjected to plastic deformation on the steel surface. According to the technique, a high carbon steel wire rod where 70% or more of the structure is pearlite or bainite or a mixture of the two is heated to and retained for 100 seconds or shorter in a temperature of 300° C. to 600° C. before wire drawing, following which the wire rod is cooled by being left as it is or with water.

Japanese Patent Application Laid-Open No. 2001-179325 proposes a technique where a coil is subjected to slow cooling and is softened. The technique however does not intend for use in a direct patenting material or a direct drawing material. Specifically, the technique discloses that the coil cooling rate on a cooling conveyor after hot rolling is controlled by adjusting steel components, austenite grain diameter at the beginning of slow cooling, wire diameter, ring space, and the temperature in a slow cooling.

However, the techniques of U.S. Pat. No. 6,783,609 and Japanese Patent Application Laid-Open No. 11-302743, have no viewpoint of diminishing the drawing resistance of a wire drawing die and improving the wire drawability, and fail in having a sufficient wire drawability required for a direct patenting material or a direct drawing material. Further, simply softening a high carbon steel wire rod after hot rolling (Japanese Patent Application Laid-Open No. 2001-179325) is also insufficient in wire drawability.

SUMMARY OF THE INVENTION

The present invention has been accomplished for solving the problems and aims at providing a high carbon steel wire rod which permits omission of a patenting treatment before or during wire drawing and which, in an as-hot-rolled state, is superior in wire drawability at a reduced drawing resistance in a drawing die, as well as a method for producing the same.

According to the present invention, for achieving the above-mentioned object, there is provided a high carbon steel wire rod superior in wire drawability and containing, in mass %, 0.65% to 1.20% of C, 0.05% to 1.2% of Si, 0.2% to 1.0% of Mn, and 0.35% or less (including 0%) of Cr, further containing P and S each in an amount restricted to 0.02% or less, with the balance being iron and unavoidable impurities, where 80% or more of the metal structure is constituted by a pearlite structure and the relation of $TS \leqq 8700/\sqrt{(\lambda/Ceq)}+290$ exists between an average tensile strength TS (MPa) and an average lamellar spacing λ (nm) of the high carbon steel wire rod. In the expression, Ceq is equal to % C+% Mn/5+% Cr/4, in view of the C content of % C, Mn content of % Mn, and Cr content of % Cr in the high carbon steel wire rod.

According to the present invention, for achieving the above-mentioned object, there is also provided a method for producing the high carbon steel wire rod superior in wire drawability, where at the time of cooling the high carbon steel wire rod to room temperature after the end of rolling, a cooling time for cooling the wire rod from 450° C. to 300° C. is set in the period of 60 seconds to 200 seconds, and thereafter the wire rod is cooled to room temperature.

The present inventors have shown the following finding. On a condition where an actual average tensile strength TS (actual tensile strength) of a high carbon steel wire rod is lower than a tensile strength (predicted tensile strength) of the high carbon steel wire rod which is predicted from an average lamellar spacing λ and a carbon equivalent Ceq of the wire rod, a high carbon steel wire rod is obtained which is superior in wire drawability, permits omission of a patenting treatment before or during wire drawing, and exhibits, in an as-hot-rolled state, a reduced drawing resistance in a wire drawing die.

TS in the expression stands for an actual average tensile strength and $8700/\sqrt{(\lambda/Ceq)}+290$ on the right side of the expression stands for a predicted tensile strength of the high carbon steel wire rod calculated from the actual Ceq and average lamellar spacing λ of the wire rod. The Ceq=% C+% Mn/5+% Cr/4 in the expression has been set originally in the present invention.

The high carbon steel wire rod having been cooled under control after hot rolling is constituted by a pearlite structure having a lamellar cementite with a certain lamellar spacing. As in the present invention, when the actual average tensile strength TS of the high carbon steel wire rod satisfies the expression and is smaller than the predicted tensile strength, it is presumed that, in this high carbon steel wire rod structure, mechanical properties of the lamellar cementite are softened while the lamellar structure of the high carbon steel wire rod being retained.

According to the above-mentioned conventional softening treatments for the high carbon steel wire rod, the lamellar spacing λ itself becomes coarse. If the lamellar spacing λ in the expression of the predicted tensile strength becomes large, the actual tensile strength would fail to become lower than the predicted tensile strength, i.e., the predicted tensile strength becomes lower, differently from the present invention. Moreover, the resistance to wire breaking in wire drawing becomes insufficient and thus satisfactory wire drawability as a direct patenting material or a direct drawing material is not obtained. It should be noted that the high carbon steel wire rod of the present invention is different from the conventional one which is merely softened to lower the tensile strength like that in a merely annealed state.

Also in the case of a high carbon steel wire rod where a lamellar cementite is not softened, the actual average tensile strength TS of the wire rod become higher. Differently from the present invention, the actual tensile strength does not become lower than the predicted tensile strength, i.e. the predicted tensile strength becomes lower. As a result, as in any of the simple softening described in the afore-mentioned techniques, the resistance to wire breaking during wire drawing becomes deficient and thus a satisfactory wire drawability required for a direct patenting material or a direct drawing material is not attained.

The predicted tensile strength results from prediction from the actual average lamellar spacing λ and carbon equivalent Ceq. In other words, the predicted tensile strength as referred to herein is a predicted tensile strength that corresponds to the actual degree of softening of the lamellar cementite or to actual average lamellar spacing λ and carbon equivalent Ceq in the high carbon steel wire rod. More specifically, the predicted tensile strength is an average tensile strength, or a tensile strength approximated thereto, of a high carbon steel wire rod where the lamellar cementite is not softened or softened in the conventional way. It should be noted that the predicted tensile strength of the present invention is not a mere calculative or statistical softening basis but is a softening limit basis capable of being expected from the lamellar spacing and carbon equivalent while the lamellar structure in the actual high carbon steel wire rod being retained.

Such a relation (basis) between the actual average tensile strength and the predicted tensile strength of the high carbon steel wire rod in the present invention is necessary from the point that, as in the present invention, even if mechanical properties of the lamellar cementite are softened, the softening itself of the lamellar cementite cannot be directly measured quantitatively.

The relation is also necessary from the point that the softened structure of the lamellar cementite cannot be distinguished from an unsoftened structure of the lamellar cementite even under a conventional structure observation method such as TEM or SEM.

Thus, in the present invention, not only the tensile strength of the high carbon steel wire rod is lowered like the conventional simple softening, but also the mechanical properties of the lamellar cementite are softened while the lamellar structure being retained. As a result, the amount of decrease in tensile strength is slight to such an extent as a predetermined tensile strength obtained by work hardening in ordinary wire drawing conditions and by heat treatment, as required, after wire drawing. Such a slight decrease of tensile strength may serve to omit the patenting treatment before or during wire drawing, and provide a high carbon steel wire rod that is superior in wire drawability, and exhibits a low drawing resistance in a wire drawing die in an as-hot-rolled state.

Figure 1:
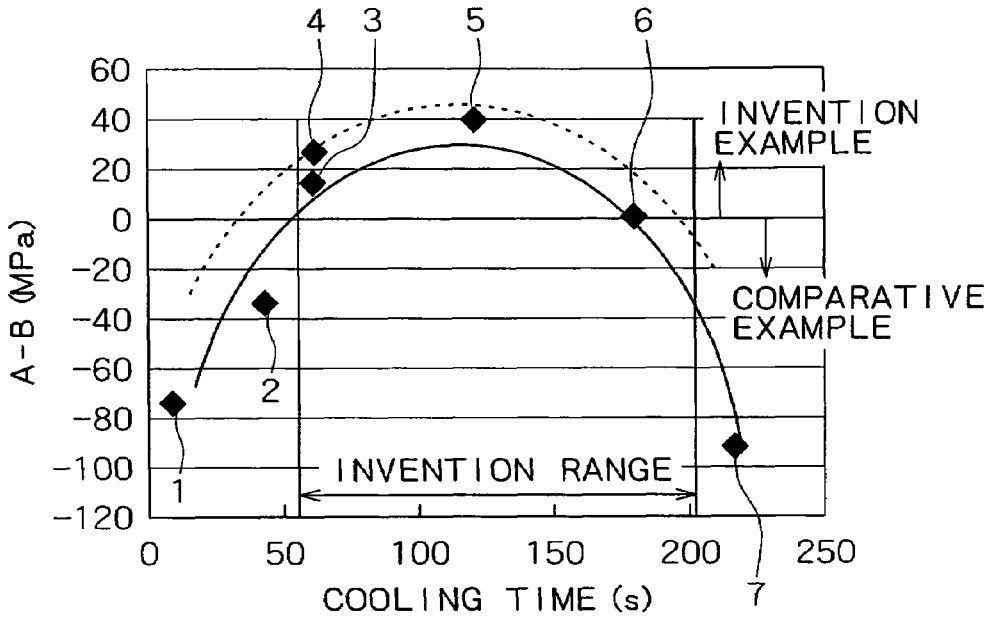
FIG. 1 is an explanatory diagram showing the difference between an actual average tensile strength TS (B) of high carbon steel wire rods and a predicted average tensile strength (A) of the steel wire rods versus a cooling time for cooling the wire rods from 450° C. to 300° C.

DESCRIPTION OF THE PREFERRED EMBODIMENTS (Metal Structure)

In the present invention, 80% or more of the metal structure in the high carbon steel wire rod is a pearlite structure. This pearlite structure indicates a structure that ferrite and cementite are arranged side by side in a lamellar form, which is obtained by eutectoid transformation when the steel wire rod is cooled from the state of austenite. Making the metal structure into such a pearlite structure is essential for basically ensuring a high strength and wire drawability of the steel wire rod. If the proportion of the pearlite structure is less than 80% and that of a supercooled structure such as bainite exceeds 20% of the metal structure, the wire drawability of the steel wire rod is basically not obtainable.

(Tensile Strength)

In the present invention, as described earlier, the actual average tensile strength TS (actual tensile strength) of the high carbon steel wire rod is made lower than the tensile strength (predicted tensile strength) of the high carbon steel wire rod predicted from the actual average lamellar spacing λ and actual carbon equivalent Ceq of the high carbon steel wire rod. If the actual average tensile strength is not made lower than that of the predicted tensile strength, it is impossible to obtain the high carbon steel wire rod which permits omitting of the patenting treatment before or during wire drawing and, in an as-hot-rolled state, exhibits a reduced drawing resistance in a wire drawing die and is superior in wire drawability.

As a known fact, the tensile strength TS (MPa) is usually determined by the lamellar spacing S (μm) and has the relation of $TS=\sigma 0+KS^{-1/2}$, where σ0 and K are constants.

On the basis of the relation between the tensile strength and the lamellar spacing, the present inventors tried to approximate the tensile strength predicted from the actual lamellar spacing as close as possible to the average tensile strength of a high carbon steel wire rod where the lamellar cementite is not softened or softened in the conventional way. To this end, the present inventors have defined the predicted tensile strength by the expression of $8700/\sqrt{(\lambda/Ceq)}+290$, considering the actual average lamellar spacing λ (nm) and actual carbon equivalent Ceq of the high carbon steel wire rod. In this expression, Ceq is also defined by the expression of Ceq=% C+% Mn/5+% Cr/4 in view of the C content of % C, Mn content of % Mn, and Cr content of % Cr of the high carbon steel wire rod.

As described above, in the case of the high carbon steel wire rod with the lamellar cementite not softened or softened in the conventional way, the actual tensile strength does not become lower than the predicted tensile strength as defined above. Conversely, the predicted tensile strength becomes lower. As a result, in either case, the resistance to wire breaking in wire drawing becomes deficient and a wire drawability satisfactory as a direct patenting material or a direct drawing material is not obtained.

That is, the actual average tensile strength TS of the high carbon steel wire rod with softened lamellar cementite becomes lower than the predicted tensile strength of the high carbon steel wire rod. On the other hand, in the case of a high steel carbon wire rod with lamellar cementite unsoftened or softened in the conventional way, its actual average tensile strength TS becomes higher than the predicted tensile strength of the high carbon steel wire rod.

As described above, the present invention aims to soften the mechanical properties of the lamellar cementite while retaining the lamellar structure of the high carbon steel wire rod. The difference in actual average tensile strength TS between the high carbon steel wire rod thus softened and the wire rod not softened is: about 30 MPa in the case of a wire rod with a relatively low carbon; and less than about 200 MPa even in the case of a wire rod with a relatively high carbon. (see the working examples) In the same way, the difference in predicted tensile strength TS between the wire rod softened in the afore-mentioned way and the wire rod softened in another way where the predicted tensile strength of the high carbon steel wire rod and the mechanical properties of the lamellar cementite are softened is: as small as less than about 10 MPa in the case of a wire rod of a relatively small carbon content; and less than about 50 MPa even in the case of a wire rod of a relatively high carbon content. (see the working examples)

The reason why the difference in tensile strength is so small is that the predicted tensile strength of the high carbon steel wire rod is not a simple tensile strength predicted from the carbon equivalent Ceq but is a predicted value by taking into account the actual average lamellar spacing λ of the high carbon steel wire rod. Another reason is that the mechanical properties of the lamellar cementite are softened while the lamellar structure of the high carbon steel wire rod being retained.

Besides, as in the present invention, in order to make the actual average tensile strength TS of the high carbon steel wire rod smaller than the predicted tensile strength of the wire rod, in other words, in order to soften the mechanical properties of the lamellar cementite, it is necessary to adopt a specific heat treatment method. The heat treatment method is conducted such that, in cooling the high carbon steel wire rod to room temperature after the end of rolling, the period of time for cooling the wire rod from 450° C. to 300° C. is to be kept in the range from 60 seconds to 200 seconds, followed by cooling to room temperature.

In the present invention, the tensile strength of the high carbon steel wire is not lowered greatly like in simple softening, but is lowered slightly to such an extent as to obtain a predetermined tensile strength, e.g., by work hardening in the usual wire drawing conditions or by heat treatment conducted as required after wire drawing. The slightly lowering process of the tensile strength can omit the patenting treatment before or during the wire drawing work and helps to obtain a high carbon steel wire rod which, in an as-hot-rolled state, exhibits a reduced drawing resistance in a wire drawing die and is superior in wire drawability.

(Components of Steel Wire)

Hereafter, the chemical components of the high carbon steel wire rod of the present invention and the reason why each element is restricted will be explained. Those are necessary or preferable information in order to satisfy properties such as high strength, high fatigue characteristic and high wire strandability that are applied for steel cords and semiconductor cutting saw wires requiring very thin wires, as well as the wire drawability.

For satisfying the required characteristics, a basic composition of the high carbon steel wire rod according to the present invention contains, in mass %, 0.65% to 1.20% of C, 0.05% to 1.2% of Si, 0.2% to 1.0% of Mn, 0.35% or less (including 0%) of Cr, 0.02% or less of P, and 0.02% or less of S, with the balance being iron and unavoidable impurities.

As required, the high carbon steel wire rod of the present invention further contains, in mass %, in addition to the basic components, one or more selected from 0.005% to 0.30% of V, 0.05% to 0.25% of Cu, 0.05% to 0.30% of Ni, 0.05% to 0.25% of Mo, 0.10% or less of Nb, 0.010% or less of Ti, 0.0005% to 0.0050% of B, and 2.0% or less of Co, or one or more selected from 0.0005% to 0.005% of Ca, 0.0005% to 0.005% of REM, and 0.0005% to 0.007% of Mg.

(C: 0.65% to 1.20%)

C is an economical and effective reinforcing element. As the content of C increases, a work hardening quantity in wire drawing and the strength after wire drawing also increase. The element C is also effective in decreasing a ferrite quantity. For allowing these functions to be exhibited to a satisfactory extent, C content of the high carbon steel needs to be 0.65% or more. However, if the content of C is too high, a net-like pro-eutectoid cementite will be produced in austenite grain boundaries, so that not only wire breaking is apt to occur during wire drawing, but also the wire drawability, and the toughness and ductility of a very thin wire after the final wire drawing, are markedly deteriorated, with consequent deterioration of the high-speed wire strandability. The upper limit of the C content is set to 1.20%.

(Si: 0.05% to 1.2%)

Si is an element necessary for the deoxidation of steel and is particularly required for deoxidation in the absence of Al. Si is also effective in enhancing the strength after patenting by dissolving in ferrite phase contained in pearlite which is formed after the patenting heat treatment. If the Si content is lower than 0.05%, the deoxidizing effect and the strength improving effect will not be exhibited to a satisfactory extent. A lower limit of the Si content is therefore set to 0.05%. If the Si content is too high, it is difficult to carry out a wire drawing process which utilizes mechanical descaling (referred to as MD, hereinafter); besides, the ductility of ferrite contained in the pearlite and that of a very thin wire after wire drawing will be deteriorated. The upper limit of the Si content is set to 1.2%.

(Mn: 0.2% to 1.0%)

Mn is also effective as a deoxidizer like Si. In the case of a steel wire rod of the present invention which does not positively contain Al, it is necessary that the deoxidizing action be exhibited effectively by the addition of not only Si but also Mn. Mn not only functions to fix S in steel as MnS and thereby enhance the toughness and ductility of steel but also is effective in enhancing the hardenability of steel to diminish proeutectoid ferrite in the rolling stock. If the content of Mn is less than 0.2%, there will be no effect. For allowing those effects to be exhibited effectively, the lower limit of the Mn content is set to 0.2%. On the other hand, since Mn is apt to undergo segregation, an excess Mn content exceeding 1.0% will cause segregation and produce supercooled structures such as bainite and martensite in the segregated portion of Mn, which thus impairs the subsequent wire drawability. The upper limit of Mn is set to 1.0%.

[Cr: 0.35% or Less (Including 0%)]

Cr is an optional element to add. Cr, unlike the other optional elements, when contained in the high carbon steel wire rod, needs to be approximated as close as possible to the average tensile strength of the high carbon steel wire rod with its lamellar cementite not softened or softened in the conventional way. The content of Cr, therefore, should be taken into account in the Ceq calculating expression for the approximation by the expression of the predicted tensile strength. The present invention defines the content of Cr as 0.35% or less (including 0%).

Cr not only improves the hardenability but also makes the lamellar structure of pearlite fine and hence makes pearlite fine. Consequently, Cr is effective in improving the strength of a very thin high carbon steel wire and the wire drawability of a wire rod. For allowing such functions to be exhibited effectively, Cr is preferably contained in an amount of 0.005% or more. If the amount of Cr is too large, undissolved cementite is liable to be formed or the time required for the completion of transformation becomes longer, with a consequent fear of formation of such supercooled structures as martensite and bainite in the hot-rolled wire rod, as well as the deterioration of the MD property. The upper limit of the Cr content is set to 0.35%.

(One or More of V, Cu, Ni, Mo, Nb, Ti, B, and Co)

Each of V, Cu, Ni, Mo, Nb, Ti, B, and Co, has a similar function in strengthening steel. Therefore, for allowing the functions of these elements to be exhibited effectively, one or more of these elements are contained optionally.

(V: 0.005% to 0.30%)

V is effective in improving the hardenability and producing a very thin steel wire with high strength. For allowing the functions to be exhibited effectively, V is contained optionally in an amount of 0.005% or more. If V is contained too much, carbides will be produced to excess to decrease the content of C to be used as a lamellar cementite. This may conversely cause the strength to be lowered or a second-phase ferrite to be produced in a large amount. The upper limit content of V is set to 0.30%.

(Cu: 0.05% to 0.25%)

Cu is effective not only in strengthening steel but also in enhancing the corrosion resistance of a very thin steel wire, but also improving the descaling property in MD to thereby prevent such a trouble as galling of the die used. For allowing such functions to be exhibited effectively, Cu is optionally contained in an amount of 0.05% or more. If the content of Cu is too high, even if the wire rods after the end of rolling is kept under the high temperature of about 90° C., blister will be formed on the wire rod surface and magnetite will also be produced in the steel matrix which underlies the blister, resulting in deterioration of the MD property. Further, Cu reacts with S, causing CuS to be segregated in grain boundaries, so that a steel ingot or the wire rod might be flawed in the wire rod manufacturing process. The upper limit of the Cu content is set to 0.25%.

(Ni: 0.05% to 0.30%)

Ni not only strengthens the steel but also improves a cementite ductility effect, and thus effectively improves the ductility such as wire drawability. For allowing such functions to be exhibited effectively, Ni is contained optionally in an amount of 0.05% or more. The upper limit of N is set to 0.30% because Ni is expensive.

(Mo: 0.05% to 0.25%)

Mo is effective in improving the hardenability and the strength of a very thin wire. For allowing such functions to be exhibited effectively, Mo is contained optionally in an amount of 0.05% or more. If Mo is contained too much, carbides will be produced to excess to decrease the content of C to be used as a lamellar cementite. This conversely lowers strength and excessively forms a second-phase ferrite. The upper limit of Mo is set to 0.25%.

(Nb: 0.020% to 0.10%)

Nb effectively strengthens the steel and suppresses the recovery, recrystallization and grain growth of austenite. This accelerates the pearlite transformation to further lower the tensile strength TS and microsize the nodule, improving the wire drawability. For allowing these functions to be exhibited, Nb is optionally contained in an amount of 0.020% or more. If the content of Nb exceeds 0.10%, the wire drawability is rather deteriorated due to excessive precipitation strengthening. The upper limit of the Nb content is set to 0.10%.

(Ti: 0.005% to 0.010%)

Ti improves not only the strength of steel but also the ductility of the wire rod by forming a carbide or nitride. For allowing these functions to be exhibited effectively, Ti is optionally contained in an amount of 0.005% or more. If the content of Ti exceeds 0.010%, the wire drawability is rather deteriorated due to excessive precipitation strengthening. The upper limit of the Ti content is set to 0.010%.

(B: 0.0005% to 0.0050%)

B is effective in improving the ductility and in suppressing the formation of a grain boundary ferrite produced in the patenting treatment. B in the wire rod can serve to suppress the grain boundary ferrite, which might be a start point to cause delamination, and thereby to more positively contribute to the suppression of the delamination. To allow such functions to be exhibited effectively, B is optionally contained in an amount of 0.0005% or more. If B is contained too much, the free B able to exhibit such effects may decrease, resulting in that a coarse compound is liable to be produced to deteriorate the ductility. The upper limit of the B content is set to 0.0050%.

(Co: 0.005% to 2.0%)

Co not only strengthens the steel but also suppresses the formation of pro-eutectoid cementite to thereby improve the ductility and wire drawability. Therefore, Co is optionally contained in an amount of 0.005% or more as a preferable lower limit value. If Co is contained too much, a longer time will be required for pearlite transformation in the patenting treatment with consequent deterioration of productivity. The upper limit of the Co content is set to 2.0%.

(One or More of Ca, REM, and Mg)

Ca, REM, and Mg are effective in forming a fine oxide in steel and making austenite to fine grains. For allowing such functions to be exhibited effectively, one or more of Ca, REM, and Mg are optionally contained in an amount of 0.0005% or more as a lower limit value of each element. If Ca, REM, and Mg are contained in amounts of exceeding 0.005%, exceeding 0.005%, and exceeding 0.007%, respectively, an oxide to be formed will become coarse, causing the wire drawability to be deteriorated. Therefore, these amounts are to be set as respective upper-limit contents, more specifically, 0.0005% to 0.005% of Ca, 0.0005% to 0.005% of REM, and 0.0005% to 0.007% of Mg should be contained.

(P: 0.02% or Less)

P is an impurity element, and the lower, the better. Particularly, in solid-solutioning of ferrite, P exerts a great influence on the deterioration of wire drawability. In the present invention, therefore, the content of P is set at 0.02% or less.

(S: 0.03% or Less)

S, which is also an impurity element, produces an MnS as an inclusion and impairs the wire drawability and therefore the content of S is set at 0.03% or less.

N is also an impurity element which dissolves in ferrite, causes age hardening due to the generation of heat during wire drawing, and thus exerts a great influence on the lowering of wire drawability. Therefore, the lower, the better. The content of N is preferably set at 0.005% or less.

(Manufacturing Method)

Next, preferred conditions for producing the high carbon steel wire rod of the present invention will be described below.

In the present invention, as described above, the actual average tensile strength TS of the high carbon steel wire rod is set lower than the predicted tensile strength of the high carbon steel wire rod. In other words, the production can advantageously be done basically by the conventional method except the period for cooling the high carbon steel wire rod from 450° C. to 300° C. after the end of rolling, which cooling period is for softening the mechanical properties of the lamellar cementite.

More specifically, a high carbon steel of the chemical composition is melted and then subjected to continuous casting, or a steel ingot thereof is subjected to blooming, to form billets. Then, after heating the billets if necessary, the finishing temperature is set, for example, in the range from 1050° C. to 800° C. to complete the hot rolling. Setting the finishing temperature at a low temperature of 1050° C. or lower leads to suppression of the recovery, recrystallization and grain growth of austenite, enabling the nodule to be fine. If the lower limit of the finishing temperature is too low, the load on the rolling machine becomes too large and is therefore set at a temperature of 800° C. or higher, preferably 900° C. or higher.

Cooling conditions under control after the finish rolling will be described below. Incidentally, although the cooling conditions under control differ dependently on the diameter of wire rod, this cooling conditions under control are applicable if the wire diameter after the finish rolling is, e.g., 3 to 8 mm, which is the conventional wire diameter range of the high carbon steel wire rods.

Cooling the wire rod to 450° C. is basically performed under quenching conditions in order to make 80% or more of the metal structure of the high carbon steel wire rod into a pearlite structure. Specifically, the quenching is preferably performed at such a high cooling rate of 5° C./s or more by, e.g., a forced cooling by means of water cooling, blast cooling, or of step cooling as a combination of those. Such a forced cooling can make 80% or more of the metal structure of the high carbon steel wire rod into a pearlite structure, and suppress the recovery, recrystallization and grain growth of austenite to thereby make the pearlite nodule fine.

The cooling rate of lower than 5° C./s suffers from the disadvantage below. Cooling to a temperature exceeding 450° C. needs a lot more time to result in longer retention time at the temperature of exceeding 450° C. This causes the lamellar cementite to be coarse in a particulate form, resulting in that the wire rod is subjected to easier separation or to tearing off and hence the wire rod during wire drawing becomes easier to break. On the other hand, if the cooling rate exceeds 20° C./s, the descaling property may possibly be deteriorated.

In the present invention, the cooling time (retention time) for cooling the wire rod from 450° C. to 300° C. is set in the period of 60 seconds to 200 seconds. If the cooling time is outside this range, the wire rod satisfying the relation of tensile strength defined in the present invention will not be obtained even if the pearlite structure is optimized by the controlled cooling performed. For example, when the wire rod temperature to be held exceeds 450° C., as described above, the lamellar cementite will becomes coarse in a particulate form with consequent deterioration of the wire drawability. If the wire rod temperature to be held is lower than 300° C., as described above, the actual average tensile strength TS of the high carbon steel wire rod cannot be made lower than the predicted tensile strength of the high carbon steel wire rod. In other words, the mechanical properties of the lamellar cementite cannot be softened while the lamellar structure being retained, failing to improve the wire drawability.

If the cooling time (retention time) for cooling the wire rod from 450° C. to 300° C. is shorter than 60 seconds, the actual average tensile strength TS of the high carbon steel wire rod cannot be made lower than the predicted tensile strength of the high carbon steel wire rod. In other words, it is impossible to soften the mechanical properties of the lamellar cementite and hence impossible to improve the wire drawability.

If the cooling time (retention time) for cooling the wire rod from 450° C. to 300° C. exceeds 200 seconds, the strength will return to the original state and hence the actual average tensile strength of the high carbon steel wire rod can not be lowered than the predicted tensile strength of the wire rod. In other words, it is impossible to soften the mechanical properties of the lamellar cementite while retaining the lamellar structure, failing to improve the wire drawability.

Thus, in order to set the cooling time (retention time) for cooling the wire rod from 450° C. to 300° C. within the period of 60 seconds to 200 seconds, it is necessary to ensure a certain length of a cooling conveyor line for the wire rod after hot rolling. Incidentally, if the cooling conveyor line is short, it is impossible to hold the wire rod in the temperature range for the predetermined time. After the certain length is ensured, the cooling rate for the coil on the cooling conveyor could be controlled through the installation of a slow cooling cover or the adjustment of the amount of the blast cooling air, depending on such conditions as components of steel, wire diameter, and ring pitch.

As for cooling to room temperature after the controlled cooling, there may be options such as standing to cool, slow cooling, and rapid cooling. In cooling to room temperature, if the wire rod temperature is lower than 300° C., the wire rod may be held at that temperature.

EXAMPLE 1

Examples of the present invention will be described below. In Example 1, high carbon steel wire rods were obtained by variously changing controlled cooling conditions (especially the cooling time for the wire rods from 450° C. to 300° C.), which wire rods were then evaluated for mechanical properties, wire drawability and drawing resistance.

From among the compositions shown in Table 1 below, high carbon steel billets of Steel Type 3 were used in common and hot rolling and subsequent controlled cooling were performed under various conditions A to G shown in Table 2 to produce steel wire rods having a diameter of 5.5 mm. In the blast cooling at temperatures from coiling temperature to 450° C., as a guide of judgment, A, B, C, E, F, and G in Table 2 may be a strong blast cooling and D a weak blast cooling.

With respect to these steel wire rods, percent pearlite area (%), average lamellar spacing (nm), average strength TS by tension test, and RA (reduction of area: %), were measured. The results of the measurements are shown in Table 3. Incidentally, as for RA (%) and tensile strength TS, a continuous 4 m long wire rod was sampled arbitrarily, from this sampled wire rods, sixteen JIS9B test pieces were continuously sampled, and from both the sixteen JIS9B test pieces and the measured RA, average values was set for tensile strength.

The percent pearlite area was determined by cutting a wire rod to obtain a sample, polishing a cross section of the sample into a mirror surface, etching the sample with use of a mixed solution of nitric acid and ethanol, and observing the structure at a central position between the surface and the center of the wire rod with use of SEM (scanning electron microscope magnifying 1000 diameters).

The average lamellar spacing was obtained by the mirror-surface polishing in the same way as above, etching the sample in the same way as above, observing the central position of the etched sample with SEM, taking 5000× photographs in ten visual fields, drawing segments perpendicular to lamellars at three finest or next finest points within each visual fields with use of the photographs in each visual field, determining a lamellar spacing from the length of each segment and the number of lamellars passing across the segment, and averaging the lamellar spacings in all the segments.

On the basis of the components shown in Table 1, Ceq=% C+% Mn/5+% Cr/4 was calculated. Then, a predicted average tensile strength (A) of each high carbon steel wire rod was determined by the expression $8700/\sqrt{(\lambda/Ceq)}+290$) through the expression of the Ceq and the obtained average lamellar spacing λ. Also obtained were a relation in magnitude between the predicted average tensile strength (A) of each high carbon steel wire rod and the actual tensile strength TS(B) of the high carbon steel wire rod, as well as the difference between (A) and (B) [(A)-(B)]. The obtained results are also shown in Table 3.

Thereafter, the steel wire rods were subjected to wire drawing directly to the diameter of 2.3 mm at a wire drawing rate of 400 m/min through non patenting treatment by means of a multi-stage dry wire drawing machine and were then evaluated for wire drawability. Regarding the wire drawing process, the wire rods were dipped in hydrochloric acid to effect descaling completely and then, for lubricating the surfaces of the steel wire rods, a zinc phosphate film was formed on the surface of each steel wire rod by zinc phosphate treatment.

Further, the 2.3 mm diameter wire rods were measured for drawing resistance value. While the wire rods were subjected to wire drawing at a rate of 15 m/min by means a single block wire drawing machine, a drawing resistance (kgf) was measured with use of a load cell. A die approach angle was set at 15°. A decrease value of drawing resistance was also calculated in comparison with a drawing resistance value in Comparative Example 1 in Table 3. The obtained results are also set out in Table 3.

As is apparent from Tables 1 and 2, the steel wire rods of Examples 3 to 6 of the present invention shown in Table 3 comprise Steel Type 3 of a chemical composition falling under the scope of the present invention, in which at least 94% of the metal structure is a pearlite structure. Also as to controlled cooling conditions after rolling, cooling times B to F for cooling the wire rods from 450° C. to 300° C. fall under the scope of the present invention.

As a result, in Examples 3 to 6 shown in Table 3, the actual average tensile strength TS(B) of the high carbon steel wire rods is lower tan the predicted average tensile strength (A) of the steel wire rods. Thus, as shown in Table 3, the wire drawability at portions (5.5 mm to 2.3 mm in diameter) which are large in wire diameter is superior and the drawing resistance at portions (2.3 mm to 2.0 mm in diameter) which are small in wire diameter is small. A drawing resistance decrease quantity is larger than that of Comparative Example 1.

In Comparative Examples 1 and 2, Steel Type 3 of a chemical composition falling under the scope of the present invention is used and at least 95% of the metal structure is a pearlite structure, but the cooling times for cooling the wire rod from 450° C. to 300° C. is shorter than 60 seconds, which is too short in (A) and (B). As a result, in Comparative Examples 1 and 2, the actual average tensile strength TS (B) of each high carbon steel wire rod is higher than the predicted average tensile strength (A) of the steel wire rod. Consequently, the wire drawability at large wire diameter portions is rather superior, but the drawing resistance at small wire diameter portions is large and a drawing resistance decrease quantity is much smaller than in the working Examples of the present invention.

Also in Comparative Example 7, Steel Type 3 of a chemical composition falling under the scope of the present invention is used and 93% of the metal structure is a pearlite structure, but the cooling time for cooling the wire rod from 450° C. to 300° C. exceeds the upper limit of 200 seconds, which is too long in (G). As a result, in Comparative Example 7, the actual average tensile strength TS (B) of the high carbon steel wire rod is higher than the predicted average tensile strength (A) of the steel wire rod. Consequently, the wire drawability at large wire diameter portions is rather superior, but the drawing resistance at small wire diameter portions is large, and a drawing resistance decrease quantity is extremely smaller than in the working Examples of the present invention.

Figure 2:
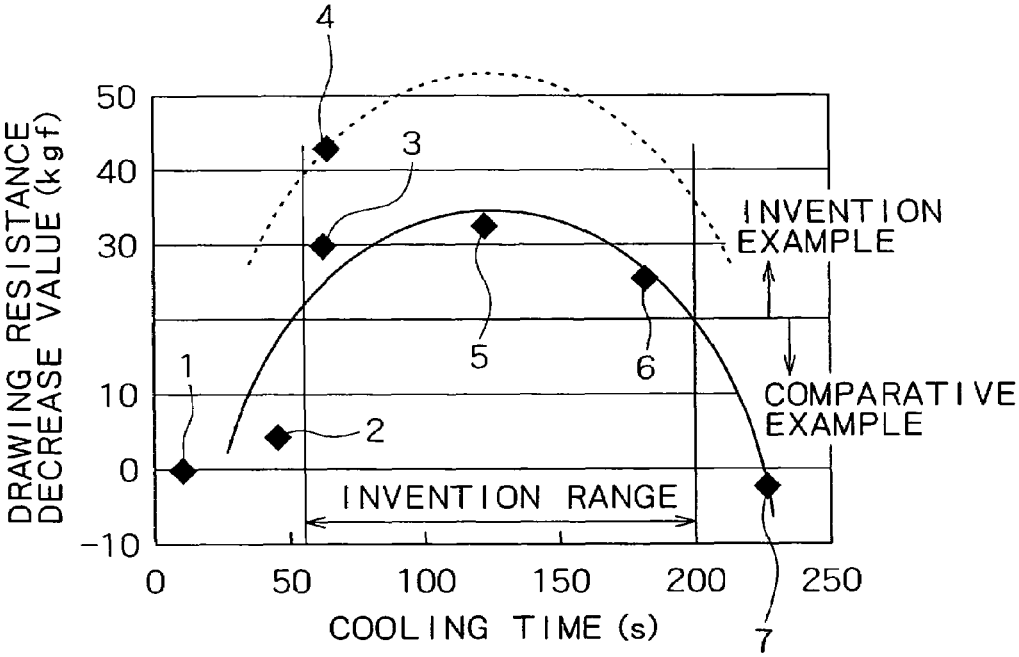
FIG. 2 is an explanatory diagram showing a relation between a drawing resistance decrease quantity of the high carbon steel wire rods and the cooling time for cooling the wire rods from 450° C. to 300° C.

FIGS. 1 and 2 show explanatory diagram showing the results set out in Table 3. FIG. 1 shows the difference (MPa:

axis of ordinate) between the actual average tensile strength TS (B) of each high carbon steel wire rod and the predicted average tensile strength (A) of the steel wire rod versus the cooling time (s: axis of abscissa) for cooling the wire rod from 450° C. to 300° C. FIG. 2 shows the drawing resistance decrease quantity versus the cooling time (s: axis of abscissa) for cooling the wire rod from 450° C. to 300° C. The numbers in FIGS. 1 and 2 correspond to the numbers of examples in Table 3. In FIGS. 1 and 2, in only Example 4 of the present invention, dotted lines were used although solid lines are used in the other Examples and Comparative Examples, because the cooling condition in Example 4 is a weak blast cooling D (softening).

From the results obtained in the Examples and shown in FIGS. 1 and 2, a critical meaning of the cooling time for cooling the wire rod from 450° C. to 300° C. being set in the period of 60 seconds to 200 second in the present invention is seen in connection with setting the average tensile strength TS of each high carbon steel wire rod at $TS \leqq 8700/\sqrt{(\lambda/Ceq)}+290$ and enlarging the drawing resistance decrease quantity. Further, a critical meaning of the conditions defined in the present invention for the wire drawability and for the drawing resistance decreasing effect at small wire diameter portions is also seen from the Examples.

TABLE 1

| | Chemical Composition of Steel (mass %, balance Fe and impurities) | | | | | | | | | | | | | | | | | | Re- |
|---|---|---|---|---|---|---|---|---|---|---|---|---|---|---|---|---|---|---|---|
| No. | C | Si | Mn | P | S | Cr | V | Cu | Ni | Mo | Nb | Ti | Co | Ca | B | REM | Mg | * Ceq | marks |
| 1 | 0.68 | 0.05 | 0.41 | 0.008 | 0.008 | 0.00 | — | — | 0.01 | 0.01 | — | 0.01 | — | 0.0010 | — | 0.0050 | 0.0011 | 0.76 | In- |
| 2 | 0.72 | 0.18 | 0.50 | 0.011 | 0.004 | 0.00 | 0.10 | — | — | — | — | — | — | — | — | 0.001 | — | 0.82 | vention |
| 3 | 0.81 | 0.25 | 0.40 | 0.009 | 0.009 | 0.00 | — | — | — | — | — | — | — | — | — | 0.001 | — | 0.89 | Ex- |
| 4 | 0.86 | 0.21 | 0.72 | 0.010 | 0.010 | 0.00 | — | — | — | — | 0.01 | — | — | — | — | 0.003 | — | 1.00 | ample |
| 5 | 0.98 | 0.14 | 0.40 | 0.015 | 0.011 | 0.00 | — | 0.05 | — | — | — | — | 1.2 | — | 0.003 | 0.002 | — | 1.06 | |
| 6 | 1.05 | 0.23 | 0.55 | 0.008 | 0.007 | 0.28 | — | — | — | — | — | — | — | — | 0.002 | 0.002 | — | 1.23 | |
| 7 | 1.15 | 0.75 | 0.77 | 0.004 | 0.007 | 0.00 | 0.25 | — | — | — | — | — | — | — | — | 0.002 | — | 1.30 | |
| 8 | 1.30 | 0.20 | 0.45 | 0.005 | 0.090 | 0.25 | — | — | — | — | — | — | — | — | — | 0.004 | — | 1.45 | Com- |
| 9 | 0.98 | 1.50 | 0.70 | 0.015 | 0.090 | 0.10 | 0.05 | — | — | — | — | — | — | — | — | 0.003 | — | 1.15 | para- |
| 10 | 0.77 | 0.08 | 1.10 | 0.011 | 0.012 | 0.00 | — | — | — | — | — | — | — | — | — | 0.002 | — | 0.99 | tive |
| | | | | | | | | | | | | | | | | | | | Ex- |
| | | | | | | | | | | | | | | | | | | | ample |

* Ceq = % C + % Mn/5 + % Cr/4

TABLE 2

| | Finish | | Controlled Rolling Conditions after Finish Rolling | | |
|---|---|---|---|---|---|
| | Rolling Conditions | | | Cooling Time | |
| No. | Wire Rod Dia. (mm) | Coiling Temp. (° C.) | Blast Cooling Conditions from Coiling Temp. to 450° C. (The cooling rate is an average cooling rate.) | for cooling from 450° C. to 300° C. (sec) | Remarks |
| A | 5.5 | 850 | Cooling at 12° C./s monotonously | 12 | Comparative Example |
| B | 5.5 | 850 | Cooling at 12° C./s monotonously | 45 | Comparative Example |
| C | 5.5 | 850 | Cooling at 12° C./s monotonously | 60 | Invention Example |
| D | 5.5 | 850 | Cooling at 10° C./s to 670° C. and 5° C./s to 450° C. | 60 | Invention Example |
| E | 5.5 | 850 | Cooling at 12° C./s monotonously | 120 | Invention Example |
| F | 5.5 | 850 | Cooling at 12° C./s monotonously | 180 | Invention Example |
| G | 5.5 | 850 | Cooling at 12° C./s monotonously | 220 | Comparative Example |

TABLE 3

| | | | Rolled | Mechanical Properties of Rolled Wire Rod | | | | | | Characteristics of Rolled Wire Rod | | | |
|---|---|---|---|---|---|---|---|---|---|---|---|---|---|
| | | | | | | | | | | Drawing | | | |
| No. | Steel Type | Controlled Cooling Conditions | Wire Rod Structure Percent Pearlite Area (%) | RA (%) | Average Lamellar Spacing (nm) | Wire Rod Strength TS (MPa) B | Predicted Wire Rod Strength (MPa) A | B ≦ A | A − B | Wire Drawability (from 5.5 mm dia. to 2.3 mm dia.) | Resistance (from 2.3 mm dia. to 2.0 mm dia.) (kgf) | *Drawing Resistance Decrease Quantity (kgf) | Remarks |
| 1 | 3 | A | 97 | 42 | 125 | 1100 | 1024 | B > A | −76 | 0 | 280 | 0 | Comparative Example |
| 2 | 3 | B | 95 | 42 | 123 | 1065 | 1030 | B > A | −35 | 0 | 275 | 5 | Comparative Example |
| 3 | 3 | C | 99 | 40 | 125 | 1008 | 1024 | B < A | 16 | 0 | 250 | 30 | Invention Example |
| 4 | 3 | D | 98 | 38 | 131 | 978 | 1007 | B < A | 29 | 0 | 235 | 45 | Invention Example |
| 5 | 3 | E | 94 | 41 | 127 | 978 | 1018 | B < A | 40 | 0 | 245 | 35 | Invention Example |
| 6 | 3 | F | 96 | 39 | 122 | 1025 | 1033 | B < A | 8 | 0 | 253 | 27 | Invention Example |
| 7 | 3 | G | 93 | 41 | 128 | 1110 | 1015 | B > A | −95 | 0 | 282 | −2 | Comparative Example |

*The drawing resistance decrease quantity is the difference in drawing resistance from Comparative Example 1.

EXAMPLE 2

Next, results obtained in Example 2 are shown in Table 4. In Example 2, 5.5 mm diameter steel wire rods of the compositions 1 to 10 in Table 1 were rolled as in Table 2, then as couples of the same steel types, were subjected to different controlled cooling conditions A (Comparative Example) and E (Invention Example). High carbon steel wire rods thus obtained were then subjected to wire drawing in the same manner as in Example 1.

Then, in the same way as in Example 1, percent pearlite area (%), RA (%), average strength TS by tension test, average lamellar spacing (nm), wire drawability, drawing resistance, and resistance decreasing quantity, of the high carbon steel wire rods were measured and evaluated. The obtained results are as shown in Table 4. The drawing resistance decreasing quantities shown in Table 4 are comparisons (differences) between the following comparative examples and examples of the present invention with respect to the same steel types, with only difference among controlled cooling conditions after rolling.

With reference to Table 4, comparisons will now be made between Comparative Example 8 and Invention Example 9, between Comparative Example 10 and Invention Example 11, between Comparative Example 12 and Invention Example 13, between Comparative Example 14 and Invention Example 15, between Comparative Example 16 and Invention Example 17, between Comparative Example 18 and Invention Example 19, and between Comparative Example 20 and Invention Example 21. As is apparent from these comparisons, even in the case of steel wire rods of steel types 1 to 7 as chemical components falling under the scope of the present invention and with 80% or more of metal structures being pearlite structures, in the Comparative Examples where the controlled cooling conditions (cooling time for cooling each steel wire rod from 450° C. to 300° C.) after rolling correspond to A (too short), actual average tensile strengths TS (B) of the high carbon steel wire rods are higher than predicted average tensile strength (A) of the steel wire rods. Consequently, the wire drawability at large wire diameter portions is rather superior, but the drawing resistance at small wire diameter portions is large and the drawing resistance decrease quantity is extremely smaller than in Invention Examples where the controlled cooling conditions correspond to E.

This tendency was also true for Comparative Examples 22 and 23 in Table 4, but since in these comparative examples Steel Type 8 (C is too high) which is outside the scope of the present invention is used, wire breaking is occurred by proeutectoid cementite even at large wire diameter portions and thus the measurement of drawing resistance at small wire diameter portions was infeasible.

This was also true for Comparative Examples 24 to 27 in Table 4, in which since Steel Type 9 (Si is too high) and Steel Type 10 (Mn is too high) in Table 1 which are outside the scope of the present invention is used, wire breaking is occurred by supercooled structures even at large diameter portions and thus the drawing resistance at small wire diameter portions could not be measured.

The afore-mentioned results shows that the chemical compositions defined in the present invention, as well as the definition of tensile strength and that of the cooling time for cooling the wire rod from 450° C. to 300° C. in the present invention, have a critical meaning for the wire drawability and for the drawing resistance decreasing effect at small wire diameter portions.

TABLE 4

| | | | Rolled | Mechanical Properties of Rolled Wire Rod | | | | | | Characteristics of Rolled Wire Rod | | | |
|---|---|---|---|---|---|---|---|---|---|---|---|---|---|
| | | | | | | | | | | Drawing | | | |
| No. | Steel Type | Controlled Cooling Conditions | Wire Rod Structure Percent Pearlite Area (%) | RA (%) | Average Lamellar Spacing (nm) | Wire Rod Strength TS (MPa) B | Predicted Wire Rod Strength (MPa) A | B ≦ A | A − B | Wire Drawability (from 5.5 mm dia. to 2.3 mm dia.) | Resistance (from 2.3 mm dia. to 2.0 mm dia.) (kgf) | *Drawing Resistance Decrease Quantity (kgf) | Remarks |
| 8 | 1 | A | 97 | 42 | 135 | 953 | 943 | B > A | −10.23 | 0 | 194 | | Comparative Example |
| 9 | 1 | E | 93 | 40.4 | 143 | 921 | 929 | B < A | 7.73 | 0 | 161 | 33 | Invention Example |
| 10 | 2 | A | 94 | 42 | 150 | 1010 | 933 | B > A | −76.75 | 0 | 245 | | Comparative Example |
| 11 | 2 | E | 96 | 40 | 130 | 975 | 981 | B < A | 5.96 | 0 | 225 | 20 | Invention Example |
| 12 | 3 | A | 97 | 42 | 125 | 1100 | 1024 | B > A | −75.89 | 0 | 280 | | Comparative Example |
| 13 | 3 | E | 94 | 41 | 127 | 978 | 1018 | B < A | 40.30 | 0 | 245 | 35 | Invention Example |
| 14 | 4 | A | 94 | 38 | 115 | 1121 | 1101 | B > A | −19.72 | 0 | 312 | | Comparative Example |
| 15 | 4 | E | 96 | 37.5 | 119 | 1041 | 1088 | B < A | 46.53 | 0 | 284 | 28 | Invention Example |
| 16 | 5 | A | 97 | 41 | 131 | 1220 | 1073 | B > A | −147.41 | 0 | 265 | | Comparative Example |
| 17 | 5 | E | 95 | 41 | 133 | 1051 | 1067 | B < A | 15.69 | 0 | 221 | 44 | Invention Example |
| 18 | 6 | A | 92 | 31 | 115 | 1320 | 1190 | B > A | −130.25 | 0 | 320 | | Comparative Example |
| 19 | 6 | E | 98 | 35 | 113 | 1175 | 1198 | B < A | 22.68 | 0 | 284 | 36 | Invention Example |
| 20 | 7 | A | 97 | 39 | 125 | 1340 | 1177 | B > A | −162.77 | 0 | 320 | | Comparative Example |
| 21 | 7 | E | 96 | 35 | 125 | 1152 | 1177 | B < A | 25.23 | 0 | 284 | 36 | Invention Example |
| 22 | 8 | A | 93 | 31 | 119 | 1488 | 1250 | B > A | −237.46 | Wire was broken (pro-eitectoid cementite) | No evaluation | — | Comparative Example |
| 23 | 8 | E | 91 | 32 | 119 | 1234 | 1250 | B < A | 16.35 | Wire was broken (pro-eitectoid cementite) | No evaluation | — | Comparative Example |
| 24 | 9 | A | 78 | 30 | — | 1477 | — | — | — | Wire was broken (supercooled structures) | No evaluation | — | Comparative Example |
| 25 | 9 | E | 72 | 31 | — | 1650 | — | — | — | Wire was broken (supercooled structures) | No evaluation | — | Comparative Example |
| 26 | 10 | A | 76 | 28 | — | 1540 | — | — | — | Wire was broken (supercooled structures) | No evaluation | — | Comparative Example |
| 27 | 10 | E | 77 | 26 | — | 1645 | — | — | — | Wire was broken (supercooled structures) | No evaluation | — | Comparative Example |

*The drawing resistance decrease quantity is the difference in drawing resistance from Comparative Example 1.

The present invention, as described above, permits a high carbon steel wire rod in which a patenting treatment can be omitted before and during wire drawing, and which is superior in wire drawability, and exhibits a low drawing resistance in a wire drawing die in an as-hot-rolled state as well as a method for producing the same.

What is claimed is:

1. A method for producing a high carbon steel wire rod, wherein the high carbon steel wire rod contains, in mass %, 0.65% to 1.20% of C, 0.05% to 1.2% of Si, 0.2% to 1.0% of Mn, and 0.35% or less (including 0%) of Cr, and further contains P and S each in an amount restricted to 0.02% or less, where 80% or more of the metal structure is constituted by a pearlite structure, and an average tensile strength TS(MPa) and an average lamellar spacing λ (nm) of the high carbon steel wire rod show the relation of $TS \leqq 8700/\sqrt{(\lambda/Ceq)}+290$ in which Ceq=% C+% Mn/5+% Cr/4, in view of the C content of % C, Mn content of % Mn, and Cr content of % Cr in the high carbon steel wire rod, wherein according to the method, the high carbon steel wire rod is produced by hot rolling followed by cooling after the hot rolling, wherein the period of time for cooling the wire rod from 450° C. to 300° C. is to be kept in the range from 60 seconds to 200 seconds, followed by cooling to room temperature.

2. The method according to claim 1, wherein the high carbon steel wire rod further contains at least one selected from 0.005% to 0.30% of V, 0.05% to 0.25% of Cu, 0.05% to 0.30% of Ni, 0.05% to 0.25% of Mo, 0.020 to 0.10% of Nb, 0.005 to 0.010% of Ti, 0.0005% to 0.0050% of B, and 0.005 to 2.0% of Co.

3. The method according to claim 1, wherein the high carbon steel wire rod further contains at least one selected from 0.0005% to 0.005% of Ca, 0.0005% to 0.005% of REM, and 0.0005% to 0.007% of Mg.

* * * * *

UNITED STATES PATENT AND TRADEMARK OFFICE

CERTIFICATE OF CORRECTION

PATENT NO. : 7,393,422 B2
APPLICATION NO. : 11/022792
DATED : July 1, 2008
INVENTOR(S) : Nagao It is certified that error appears in the above-identified patent and that said Letters Patent is hereby corrected as shown below:

On the title page, Item (73), the Assignee information is incorrect. Item (73) should read:

-- (73) Assignee: Kabushiki Kaisha Kobe Seiko Sho (Kobe Steel, Ltd.), Kobe-shi (JP) --

Signed and Sealed this

Twenty-sixth Day of August, 2008

JON W. DUDAS
*Director of the United States Patent and Trademark Office*